US006020030A

United States Patent [19]

Guthrie et al.

[11] Patent Number: 6,020,030

[45] Date of Patent: Feb. 1, 2000

[54] COATING AN ALUMINUM ALLOY SUBSTRATE

[75] Inventors: Joseph D. Guthrie, Murrysville, Pa.; Alfred M. Dennis, Newburgh, Ind.

[73] Assignee: Aluminum Company of America, Pittsburgh, Pa.

[21] Appl. No.: 09/074,136

[22] Filed: May 7, 1998

[51] Int. Cl.[7] ..... B05D 1/36; B05D 1/38

[52] U.S. Cl. ..... 427/345; 427/399; 210/681

[58] Field of Search ..... 427/399; 210/681

[56] References Cited

U.S. PATENT DOCUMENTS

| | | | |
|---|---|---|---|
| 3,276,868 | 10/1966 | Uhlig | 96/1.5 |
| 4,153,461 | 5/1979 | Berghauser et al. | 96/75 |
| 4,206,049 | 6/1980 | Stana et al. | 210/22 R |
| 4,747,954 | 5/1988 | Vaughn et al. | 210/670 |
| 4,861,490 | 8/1989 | Morris | 210/681 |
| 5,103,550 | 4/1992 | Wefers et al. | 29/527.4 |
| 5,277,788 | 1/1994 | Nitowski et al. | 205/175 |
| 5,368,974 | 11/1994 | Walls et al. | 430/156 |
| 5,534,238 | 7/1996 | Kajiwara et al. | 423/584 |

OTHER PUBLICATIONS

Dowex Ion Exchange Resins, Dowex MSC–1, A Macroporous Cation Exchange Resin for Water Treatment and Non–Water Applications, Product Information, Published Apr. 1996.

Dowex Ion Exchange Resins, Power Chemical Processing Tools, Published Jun. 1997, Form No. 177–01395–697QRP.

*Primary Examiner*—Shrive Beck
*Assistant Examiner*—Michael Cleveland
*Attorney, Agent, or Firm*—Glenn E. Klepac

[57] ABSTRACT

An aluminum alloy substrate is pretreated with an aqueous solution containing an organophosphorus compound, preferably a vinyiphosphonic acid-acrylic acid copolymer, before coating the substrate with a polymer. Passing the substrate through the solution contaminates it with aluminum and other elements. The pretreatment solution is rejuvenated by removing aluminum with a cation exchange resin that preferably contains a styrene-divinyl benzene copolymer functionalized with sulfonate groups. Rinsing the substrate contaminates the rinse water with the copolymer. The rinse water is concentrated by reverse osmosis or membrane ultrafiltration and returned to the pretreatment solution.

22 Claims, 1 Drawing Sheet

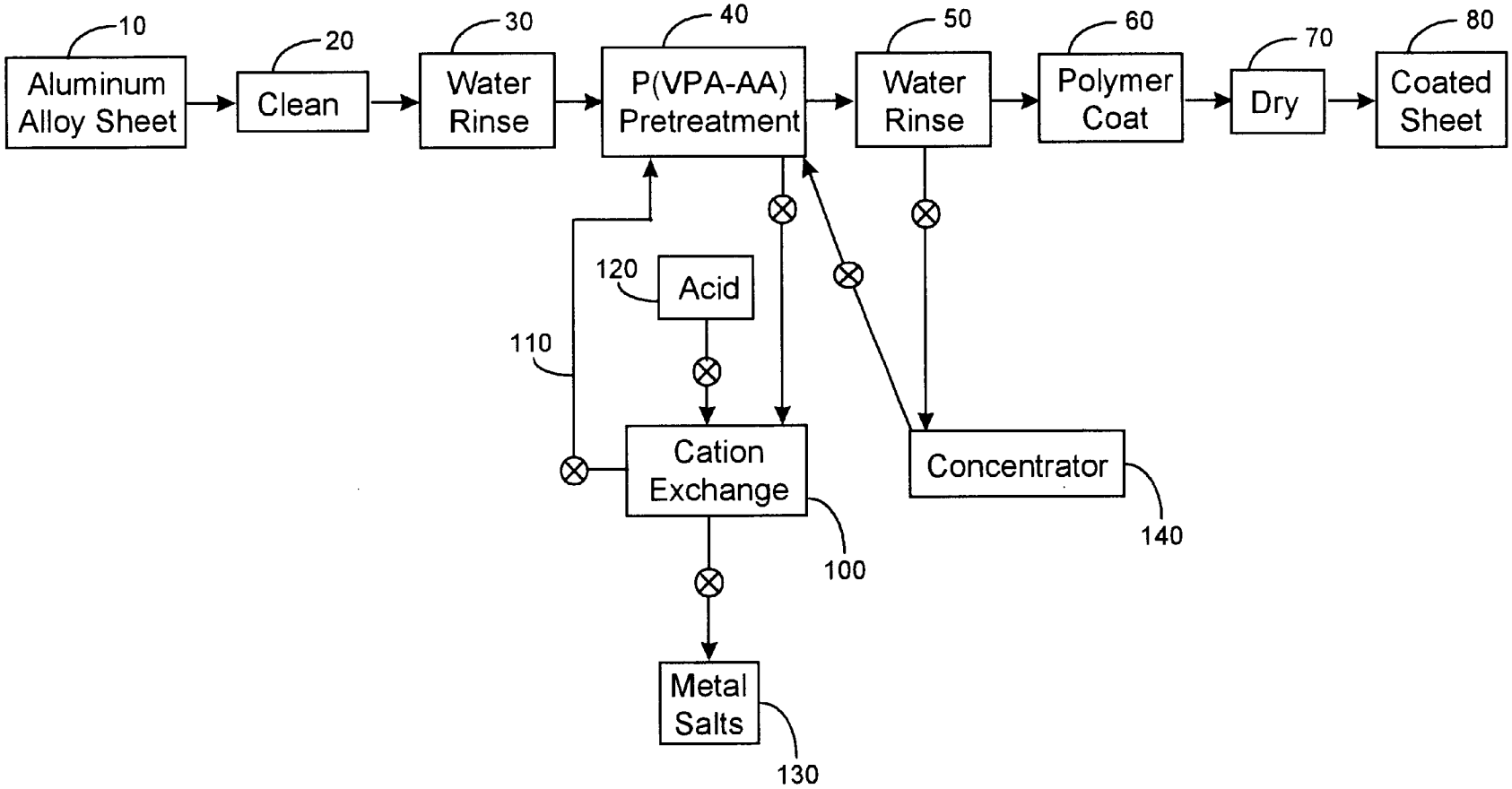
FIGURE

COATING AN ALUMINUM ALLOY SUBSTRATE

FIELD OF THE INVENTION

The present invention relates to a process for coating an aluminum alloy substrate with a polymer. More particularly, the invention relates to a process for pretreating an aluminum alloy substrate with a vinyl phosphonic acid-acrylic acid copolymer before polymer coating the substrate.

BACKGROUND OF THE INVENTION

Although aluminum protects itself against corrosion by forming a natural oxide coating, the protection is not complete. In the presence of moisture and electrolytes, aluminum alloys corrode much more rapidly than pure aluminum.

Accordingly, there is a need to treat aluminum alloy substrates with pretreatments or other chemicals that provide improved corrosion resistance as well as good adhesion for polymers.

In the prior art, chemical conversion coatings have been formed on aluminum alloys by "converting" a surface of the metal into a tightly adherent coating, part of which consists of an oxidized form of aluminum. Chemical conversion coatings provide high corrosion resistance and improved adhesion for polymer coatings. A chromium-phosphate conversion coating is typically provided by contacting aluminum with an aqueous solution containing hexavalent chromium ions, phosphate ions and fluoride ions. In recent years, concerns have arisen regarding the pollution effects of chromates and phosphates discharged into waterways by such processes. Because of the high solubility and strongly oxidizing character of hexavalent chromium ions, expensive waste treatment procedures must be employed to reduce the hexavalent chromium ions to trivalent chromium ions for waste disposal.

Attempts have been made in the prior art to produce acceptable chromate-free conversion coatings for aluminum. For example, some chromate-free conversion coatings contain zirconium, titanium, hafnium and/or silicon, sometimes combined with fluorides, surfactants and polymers such as polyacrylic acid. In spite of the extensive efforts that have been made previously, there is still no entirely satisfactory non-chromate conversion coating or primer for improving the adhesion and corrosion resistance of polymer coated aluminum alloy substrates. Polymer adhesion and corrosion resistance are important characteristics in aluminum alloy sheet used for making food container bodies and ends and beverage container ends.

Attempts have also been made in the prior art to pretreat substrates with various organophosphorus compounds before coating them with a polymer. As used herein, the term "organophosphorus compounds" includes organophosphoric acids, organophosphinic acids, organophosphonic acids, as well as various salts, esters, partial salts, and partial esters of such acids. For example, Dutch Patent Application No. 263,668, filed Apr. 14, 1961, discloses a process wherein steel sheets are treated with a vinylphosphonic acid/acrylic acid copolymer before coating with an alkyd resin enamel. Although some organophosphorus pretreatments may perform adequately, they are expensive to implement. Accordingly, there still remains a need to provide an efficient and economical process for pretreating an aluminum alloy substrate with an organophosphorus compound before applying a polymer coating.

A principal objective of the present invention is to provide an efficient and economical process for pretreating an aluminum alloy substrate with an organophosphorus compound before applying a polymer coating.

To accomplish this principal objective our process provides for removing aluminum and other cations from pretreatment solutions, thereby avoiding costly disposal of such solutions.

Additional objectives and advantages of our invention will become apparent to persons skilled in the art from the following detailed description.

BRIEF DESCRIPTION OF THE DRAWING

The sole FIGURE is a flowsheet diagram of the process of the present invention.

SUMMARY OF THE INVENTION

In accordance with our invention there is provided a process for coating an aluminum alloy substrate with an organic polymer. The aluminum alloy substrate may be provided in the form of a sheet, plate, extrusion or casting and is preferably a sheet.

Various aluminum alloys available in sheet form are suitable for practice of the present invention, including alloys belonging to the AA2000, 3000, 5000, 6000 and 7000 series. Aluminum-magnesium alloys of the AA5000 series and particularly the AA5042 and AA5182 alloys are preferred. Sheet made from these alloys is useful for shaping into polymer coated food container bodies or ends, and beverage container ends.

Aluminum alloys suitable for container end panels such as AA 5182 are provided as an ingot or billet or slab by casting techniques known in the art. Before working, the ingot or billet is subjected to elevated temperature homogenization. The alloy stock is then hot rolled to provide an intermediate gauge sheet. For example, the material may be hot rolled at a metal entry temperature of about 700°–975° F. to provide an intermediate product having a thickness of about 0.100 inch to 0.150 inch. This material is cold rolled to provide a sheet ranging in thickness from about 0.006 to 0.015 inch. We prefer AA 5182 aluminum alloy sheet in the H19 temper. Aluminum alloy 5042 sheet for end panels is preferably in the H19 temper.

Aluminum alloys such as AA 5042 are provided as an ingot that is homogenized. This is followed by hot rolling to an intermediate gauge of about 0.100 inch to 0.150 inch. Typically, the intermediate gauge product is annealed, followed by hot rolling and then cold rolling to a final gauge product having a thickness of about 0.006 to 0.015 inch. The sheet is coated with a polymer and then drawn and redrawn into food container bodies. We prefer AA 5042 aluminum alloy sheet in the H2x temper.

The natural oxide coating on an aluminum alloy sheet surface is generally sufficient for practice of our invention. The natural oxide coating ordinarily has a thickness of approximately 30–50 angstroms. For better protection against corrosion, the oxide coating can be grown by treatments such as anodic oxidation or hydrothermal treatment in water, water vapor or aqueous solutions.

Aluminum alloy sheet of the invention is generally cleaned with an alkaline surface cleaner to remove any residual lubricant adhering to the surface, and then rinsed with water. Cleaning can be avoided if the residual lubricant content is negligible.

The cleaned sheet surface is then pretreated in a first container with a composition comprising an aqueous solution of an organophosphorus compound. The solution preferably contains about 1–20 g/L of a vinyl phosphonic acid-acrylic acid copolymer (VPA-AA copolymer). Solutions containing about 4–10 g/L of the copolymer are preferred. The copolymer usually comprises about 5–50 mole % vinylphosphonic acid, preferably about 20–40 mole %. The VPA-AA copolymer may have a molecular weight of about 20,000 to 100,000, preferably about 50,000 to 80,000. A particularly preferred VPA-AA copolymer contains about 30 mole % VPA and about 70 mole % AA. The solution has a temperature of about 100°–200° F., more preferably about 120–°–180° F. A particularly preferred solution has a temperature of about 170° F.

The sheet surface may be dipped into the composition or the composition may be roll coated or sprayed onto the sheet surface. A preferred continuous cleaning and pretreating line is operated at about 500–1500 feet per minute. A contact time of about 6 seconds between the sheet surface and the composition is sufficient when the line is operated at 1000 feet per minute. The VPA-AA copolymer reacts with the oxide or hydroxide coating to form a layer on the sheet surface.

Aluminum alloy sheet passing through the pretreatment solution contaminates the solution with ions of various elements, including aluminum, magnesium, iron, chromium and manganese. The pretreatment solution loses effectiveness when the aluminum concentration rises above about 150–200 ppm. Accordingly, we provide a process for removing ions of aluminum and other metals from the pretreatment solution.

At least a portion of the pretreatment solution is transferred to a second container containing a cation exchange resin. The resin may be provided as pellets, beads, fibers, or particles and preferably is a hard, spherical gel type bead. The resin has a minimum total capacity in the hydrogen form, wet, of 1.9 meq/mL. A preferred resin has an average particle size of about 650 microns, a specific gravity of about 1.22–1.23, and a bulk density of about 49.9 lb/ft$^3$.

The resin is preferably a gel comprising a styrene-divinylbenzene copolymer functionalized with acid groups, preferably sulfonate groups. Alternatively, the copolymer may be functionalized with phosphonic acid or arsonic acid groups. A particularly preferred cation exchange resin is sold by The Dow Chemical Company of Midland, Mich. under the trademark DOWEX G-26(H).

Less preferably, the cation exchange resin may comprise ethylene copolymerized with an unsaturated carboxylic acid such as acrylic acid.

After the pretreatment solution passes through the second container, it contains a reduced concentration of aluminum. The aluminum concentration in the treated solution is less than about 75 ppm, more preferably less than about 25 ppm, and optimally about 10 ppm or less. The treated solution, containing the organophosphorus compound and a reduced concentration of aluminum, is returned to the first container.

Optionally, the pretreated sheet may be rinsed with water to remove excess VPA-AA copolymer. The rinse water preferably has a temperature of about 170°–180° F. The rinse water is concentrated by removing excess water so that the VPA-AA copolymer can be recycled. Some preferred concentrating techniques include reverse osmosis and membrane filtration. After concentration, the rinse water may be transferred to the first container in order to recover VPA-AA copolymer values.

The primed sheet is coated with a polymer composition that preferably includes an organic polymer dispersed in an organic solvent. Three preferred coating polymers are the epoxies, polyvinyl chloride and polyesters. The suitable epoxies include phenolic-modified epoxies, polyester-modified epoxies, epoxy-modified polyvinyl chloride, and cross linkable epoxies. The polymer composition may be clear or it may contain pigment particles. The pigment particles are preferably titanium dioxide, alumina or silica. We prefer titanium dioxide particles in the 0.5 to 10 microns median particle size range.

Alternatively, the primed sheet may be coated by electrocoating, slot coating, extrusion coating, flow coating, spray coating, or other continuous coating processes.

The polymer coated sheet is dried, coiled, and then finally shaped into container bodies or container end panels.

DETAILED DESCRIPTION OF PREFERRED EMBODIMENTS

As shown schematically in the FIGURE, there is provided a coil of AA5182-H19 aluminum-magnesium alloy sheet 10 having a thickness of about 8.8 mils (224 microns). The sheet 10 is cleaned with an alkaline surface cleaner in a vat 20 to remove any residual lubricant on the sheet surface. The cleaned sheet is then rinsed in a deionized water bath 30.

The cleaned and rinsed sheet is pretreated in a first container 40 with a solution comprising about 10 g/L of a VPA-AA copolymer containing about 30 mole percent VPA and about 70 mole percent AA units, dissolved in water. The solution has a temperature of about 170° F. (77° C.) and it initially contains about 10 ppm aluminum. The VPA-AA copolymer reacts with an aluminum oxide or hydroxide coating on the sheet surface to form a layer comprising a reaction product of the copolymer and the oxide or hydroxide.

The pretreated sheet is then rinsed with water 50 to remove excess VPA-AA copolymer. The rinse water 50 preferably has a temperature of about 170°–180° F.

The rinsed sheet is roll coated with a polymer composition 60 that preferably includes an organic polymer and pigment particles dispersed in an organic solvent. The organic polymer is preferably an epoxy resin. Some suitable epoxies include phenolic-modified epoxies, polyester-modified epoxies, epoxy-modified polyvinyl chloride, and cross linkable epoxies.

The polymer coated sheet is dried in a hot air dryer 70 and then recoiled as a coated sheet product 80.

In order to maintain a low concentration of metal ions in the pretreatment solution, portions of the solution are periodically transferred from the first container 40 to a second container 100 holding a cation exchange resin. A particularly preferred resin is sold by Dow Chemical Company of Midland, Michigan under the trademark DOWEX G-26 (H) strong cation exchange resin. The strong cation exchange resin is sold as hard spherical beads with a 650 micron dry mesh size. The strong cation exchange resin is a gel comprised of a styrene-divinyl benzene copolymer functionalized with sulfonate groups. Treatment with the resin produces a treated solution having an aluminum concentration that is optimally less than about 10 ppm. The treated solution is returned through a pipe 110 from the second container 100 to the first container 40.

The cation exchange resin eventually becomes saturated with metal salts. The resin is regenerated by washing with a strong acid solution 120, such as 6–10 vol. % HCl or 6–12 vol. % sulfuric acid in water. Metal salts 130 washed from the second container 100 are discarded.

Used rinse water from the water rinse 50 is also recycled to recover VPA-AA copolymer values. The used rinse water is first sent to a concentrator 140 where water is removed, for example by reverse osmosis or membrane ultrafiltration. The concentrated rinse water is then returned to the first container 40.

The cation exchange process of our invention maintains aluminum concentrations at acceptable levels in the pretreatment solution. A 200 mL aliquot of the pretreatment solution at 140° F. containing 10 g/L VPA-AA copolymer, 350 ppm aluminum, and other metals was placed in a 250 mL Ehrlenmeyer flask containing 40 mL wet volume of the DOWEX G-26(H) resin in the hydrogen form. The flask was placed in a water bath and held at 140° F. (60° C.) for 16–20 hours. The resin was prepared by washing with 400–600 mL of 6 vol. % HCl, followed by rinsing with 600–800 mL of deionized water.

After 16 to 20 hours of contact time, the pretreatment solution was filtered and the resin was rinsed with 25 mL of deionized water. The solution was analyzed and the results are presented below in the Table. All concentrations were corrected to reflect a volume of 200 mL, for comparison.

TABLE

Analysis of Pretreatment Solution

| Element | Initial Concentration (ppm) | After G-26(H) (ppm) |
|---|---|---|
| Al | 350 | 5.3 |
| Na | 14 | 0.5 |
| Si | 11 | 12 |
| Fe | 22 | 18 |
| Ca | 4.1 | 0.8 |
| Mg | 100 | 0.3 |
| Mn | 1.5 | n.d. |
| Ni | 0.6 | n.d. |
| Zn | 0.3 | n.d. |
| Cr | 11 | 10 |
| K | 1.8 | 0.5 |
| P | 820 | 777 |

n.d. = non detectable

Having described the invention with reference to some presently preferred embodiments, persons skilled in the art will understood that our invention may be otherwise embodied without departing from the spirit and scope of the appended claims.

What is claimed is:

1. A process for coating an aluminum alloy substrate with a polymer, comprising:

(a) providing an aluminum alloy substrate having a surface portion comprising aluminum oxide or aluminum hydroxide;

(b) in a first container, pretreating said substrate with an aqueous pretreatment solution consisting essentially of water, an organophosphorus compound and metal ions, thereby to form a layer comprising a reaction product of said compound and said oxide or hydroxide, and wherein said substrate contaminates said solution with aluminum;

(c) transferring at least a portion of said pretreatment solution to a second container containing a cation exchange resin, and therein adsorbing aluminum onto said resin and producing a treated solution containing a reduced concentration of aluminum;

(d) returning said treated solution from said second container to said first container; and (e) coating said layer with a coating composition comprising a polymer selected from the group consisting of polyvinyl chloride, epoxies and polyesters.

2. The process of claim 1 further comprising:

(f) after step (b), rinsing said substrate with water, thereby to produce rinse water containing said organophosphorus compound and aluminum; and (g) concentrating said rinse water by removing water therefrom.

3. The process of claim 2 further comprising:

(h) returning to the first container at least a portion of the rinse water treated in step (g).

4. The process of claim 1 wherein said organophosphorus compound comprises a vinylphosphonic acid-acrylic acid copolymer.

5. The process of claim 4 wherein said copolymer comprises about 5–50 mole percent vinylphosphonic acid.

6. The process of claim 4 wherein said copolymer has a molecular weight of about 20,000 to 100,000.

7. The process of claim 4 wherein said pretreatment solution comprises about 1–20 g/L of said copolymer.

8. The process of claim 4 wherein said pretreatment solution has a temperature of about 120–200° F. (49–93° C.) in step (b).

9. The process of claim 1 wherein said resin comprises a styrene-divinyl benzene copolymer.

10. The process of claim 1 wherein said resin is functionalized with sulfonate groups.

11. The process of claim 1, wherein step (b) is performed without anodically oxidizing said substrate.

12. The process of claim 1, wherein the treated solution contains less than about 75 ppm aluminum.

13. The process of claim 1, wherein the treated solution contains less than about 25 ppm aluminum.

14. A process for pretreating an aluminum alloy sheet having a surface portion in order to improve adhesion of a polymer coating to said surface portion, comprising:

(a) in a first container, pretreating an aluminum alloy sheet having a surface portion comprising aluminum oxide or aluminum hydroxide with a solution consisting essentially of water, an organophosphorus compound, and metal ions, thereby forming a layer comprising a reaction product of said compound and said oxide or hydroxide, and contaminating said solution with aluminum ions;

(b) transferring at least a portion of said solution to a second container containing a cation exchange resin comprising a polymer functionalized with sulfonate groups and therein adsorbing aluminum ions onto said resin, thereby producing a treated solution containing said compound and having a reduced concentration of aluminum ions; and (c) returning said treated solution to said first container.

15. The process of claim 14 further comprising:

(d) coating said layer with a coating composition comprising a polymer selected from the group consisting of polyvinyl chloride, epoxies and polyesters.

16. The process of claim 14 wherein said resin comprises a styrene-divinylbenzene copolymer.

17. The process of claim 14 wherein said sheet comprises an aluminum alloy of the AA 2000, 3000, 5000, 6000 or 7000 series.

18. The process of claim 14 wherein said sheet comprises an aluminum alloy of the AA 5000 series.

19. The process of claim 14 wherein step (a) is performed without anodically oxidizing said substrate.

20. The process of claim 14 wherein the treated solution contains less th an about 75 ppm aluminum.

21. The process of claim 14, wherein the treated solution contains less than about 25 ppm aluminum.

22. A process for treating an aluminum alloy sheet having a surface portion in order to improve adhesion of a polymer coating to said surface portion, comprising:

(a) in a first container, pretreating an aluminum alloy sheet having a surface portion comprising aluminum oxide or aluminum hydroxide with a solution consisting essentially of water and a vinyl phosphonic acid-acrylic acid copolymer without anodically oxidizing said surface portion, thereby forming a layer comprising a reaction product of said copolymer and said oxide or hydroxide, and contaminating said solution with aluminum ions;

(b) transferring at least a portion of said solution to a second container containing a cation exchange resin and therein adsorbing aluminum ions onto said resin, thereby producing a treated solution containing said copolymer and having a reduced concentration of aluminum ions; and (c) returning said treated solution to said first container.

* * * * *